US006722814B2

(12) United States Patent
Byrne

(10) Patent No.: US 6,722,814 B2
(45) Date of Patent: Apr. 20, 2004

(54) TRENCH COVER ELEMENT

(76) Inventor: David Vincent Byrne, 21 Glasilawn Road, Glasnevin, Dublin 11 (IE)

( * ) Notice: Subject to any disclaimer, the term of this patent is extended or adjusted under 35 U.S.C. 154(b) by 0 days.

(21) Appl. No.: 10/097,854

(22) Filed: Mar. 15, 2002

(65) Prior Publication Data

US 2002/0092100 A1 Jul. 18, 2002

Related U.S. Application Data

(63) Continuation of application No. PCT/IE00/00108, filed on Sep. 18, 2000.

(30) Foreign Application Priority Data

Sep. 17, 1999 (WO) ..... PCT/IE99/00096

(51) Int. Cl.[7] ..... E02D 29/14

(52) U.S. Cl. ..... 404/35; 52/581; 52/588.1; 52/589.1

(58) Field of Search ..... 14/69.5, 2.4; 52/581, 52/588.1, 589.1; D34/32; 404/35, 37, 38; 198/850

(56) References Cited

U.S. PATENT DOCUMENTS

| | | | | | |
|---|---|---|---|---|---|
| 22,036 | A | * | 11/1858 | Savage | 75/333 |
| 2,282,559 | A | | 5/1942 | Byers | |
| 3,344,905 | A | * | 10/1967 | von Hofen | 198/850 |
| 3,377,931 | A | * | 4/1968 | Hilton | 404/35 |
| 4,801,483 | A | | 1/1989 | Beckerman et al. | 428/71 |
| 5,032,037 | A | * | 7/1991 | Phillips et al. | 404/35 |
| 5,098,218 | A | * | 3/1992 | Reese et al. | 404/35 |
| 5,179,752 | A | * | 1/1993 | Clough et al. | 14/73 |
| 5,282,692 | A | | 2/1994 | McLeod | 404/35 |
| 5,364,204 | A | * | 11/1994 | MacLeod | 404/35 |
| 5,647,184 | A | * | 7/1997 | Davis | 52/100 |
| 5,758,467 | A | * | 6/1998 | Snear et al. | 52/177 |
| 5,819,491 | A | * | 10/1998 | Davis | 52/100 |
| 6,339,908 | B1 | * | 1/2002 | Chuang | 52/177 |

FOREIGN PATENT DOCUMENTS

| | | | |
|---|---|---|---|
| DE | 443440 | | 4/1927 |
| EP | 0035594 | A2 | 9/1981 |
| EP | 0431777 | A1 | 6/1991 |
| GB | 509120 | | 7/1939 |
| GB | 2 282 622 | * | 4/1995 |
| GB | 2305954 | A | 4/1997 |
| GB | 2321486 | A | 7/1998 |
| HU | 251 | A | 3/1994 |
| WO | WO 01/21898 | * | 3/2001 |

* cited by examiner

*Primary Examiner*—Gary S. Hartmann
(74) *Attorney, Agent, or Firm*—Jacobson Holman PLLC

(57) ABSTRACT

A temporary trench cover includes a number of cover elements which are of prefabricated or cast metal construction. An interlink for interengaging like cover elements on assembly includes a male head part at one end and a female slot at an opposite end. The male part engages with the female slot in such a way as to allow limited controlled relative movement between adjacent cover elements on assembly in both the horizontal and vertical planes. In this way the cover elements readily follow the contour of the ground in which the trench is dug.

32 Claims, 13 Drawing Sheets

TRENCH COVER ELEMENT

This is a continuation application of PCT/IE00/00108, filed Sep. 18, 2000.

The invention relates to a trench cover for temporarily covering a trench made in a footpath or roadway.

Digging trenches for laying cables, pipes and the like is extremely labour intensive. There are severe constraints on efficient digging because of the need to complete the digging, fitting and filling operation as quickly as possible. This is especially difficult in situations where the path or roadway must be kept open. Thus, a considerable amount of work is required to backfill trenches while the trench digging work is ongoing. Regularly, a large proportion of the available working day is involved in temporary backfilling and the renewal of the backfilling to allow the work to continue. This is a major cost factor as not only is their a high labour content but also backfill is generally a waste product that cannot be used as permanent trench filling.

Various attempts have been made to provide a trench cover to temporarily cover a trench. Such trench covers however have a number of disadvantages and are consequently used infrequently, backfilling being the preferred option.

U.S. Pat. No. 4,801,483 describes a ground opening cover with anchoring holes for anchoring the cover in place. It is not practical to temporarily cover a trench with such plates as each plate must be anchored separately and each of these anchors must be released to remove the cover.

GB-A-2305954 describes a temporary trench cover comprising an upper plate with depending walls for inserting into the trench. An angle piece is secured to one depending wall to provide a connection means in the form of a channel having an upwardly opening mouth into which an opposite depending wall of an adjacent plate is engaged. While such an arrangement prevents longitudinal movement between adjacent cover plates the plates are easily removed by pulling the plates upwardly using the finger receiving apertures. Thus, the plates are not secured against unauthorised removal. In addition, the arrangement does not facilitate covering of a trench which is not straight.

EP-A-0431777 describes a cover for temporarily covering a trench which is releasably engagable with an adjacent cover. The cover is a tight fit in a trench and the arrangement does not facilitate relative movement between adjacent cover elements. Further, unauthorised removal is not prevented as the covers can be relatively easily removed by moving a cover out of the general plan of the assembly.

GB-A-2 321 486 describes a temporary trench cover comprising a hollow shell of plastics material with a downwardly protruding portion to define lateral abutment faces which are spaced apart by a width corresponding to the width of the trench so as to engage the side walls of the trench. The cover may have a part-circular tongue at one end for engaging in a corresponding part-circular recess defined by an open-ended socket of an adjacent element to allow adjacent cover elements to be articulated. Such an arrangement is difficult to manufacture and, the covers can be relatively easily removed by unauthorised personnel by moving a cover out of the general plan of the assembly. In addition, while the arrangement illustrates relative movement between adjacent covers the gaps between adjacent covers presents a hazard as, for example, a bicycle wheel may become wedged in the gap with attendant safety problems.

This invention is therefore directed towards providing an improved trench cover which will overcome at least some of these problems.

STATEMENTS OF INVENTION

According to the invention there is provided temporary trench cover element comprising a cover member for extending over a trench, the cover member comprising a pair of ground engaging portions bridged by a central trench covering portion, the ground engaging portions defining a pair of opposite sides for location outside of a trench and the cover member having a pair of transverse ends extending transversely between the opposite sides, confinement means extending downwardly from the central portion of the cover member to confine the cover with respect to a trench opening and interlink means comprising a first interlink means at one transverse end and a complementary second interlink means at an opposite transverse end, one of the first or second interlink means being engagable underneath the other of the first and second interlink means of a like cover element on assembly, a cover element being relatively movable with respect to an adjacent cover element to follow the contour of a trench.

In a preferred embodiment of the invention one of the interlink means is oversize with respect to the other of the interlink means to allow limited relative movement between the interlink means so that the cover elements follow the contour of the ground.

Preferably wherein the interlink means of adjacent cover elements are relatively moveable in a vertical direction and/or a horizontal direction to follow the vertical contour of the trench.

In one embodiment of the invention the first interlink means comprises a head part projecting from a transverse end of a cover member and the second interlink means comprises a slot adjacent a transverse end of a cover member to receive the head part of a first interlink means of an adjacent like cover element on assembly.

Preferably, in one embodiment the second interlink means comprises a slot defined in an underside of the cover member. In a preferred embodiment the slot is a downwardly opening slot and the head part engages in the slot from below. Ideally the slot is oversize with respect to the head part to allow limited relative movement between the head part and the slot so that a cover element may be moved relative to an adjacent cover element to follow the contour of a trench. In one arrangement the slot is defined in an underside of the central portion of the cover member.

In a particularly preferred embodiment of the invention the interlink means includes at least one wing which extends from a transverse end of the cover member. Most preferably the at least one wing extends for a distance to bridge at least portion of a gap between adjacent cover elements, on assembly.

Ideally the cover member has a wing receiving recess to receive portion of the end wing of an adjacent cover element, on assembly.

The end wing is preferably located to one side of one or both of the interlink means. Preferably there are two transversely spaced-apart end wings. In one embodiment the first interlink means is a slot at a first transverse end of the cover and the or each wing extends from the first transverse end.

Most preferably the or each end wing extends from one cover element underneath an adjacent cover element, on assembly.

In a particularly preferred embodiment at least one transverse end is shaped to facilitate limited relative movement between end marginal edges of adjacent cover elements. Ideally at least one end marginal edge is at least partially of curvilinear shape, preferably of arcuate shape, ideally of generally convex shape.

In another embodiment of the invention the first interlink means comprises a male part projecting from one transverse end and the second interlink means comprises a slot adjacent the opposite transverse end for receiving the head part of an adjacent like cover element, on assembly, the head part and slot being shaped to facilitate assembly of the head part into the slot in a first orientation of the cover element and to prevent removal of the head part from the slot in another, assembled orientation.

In this case preferably the male part has a projecting head section and a neck section of reduced width with respect to the head section. Ideally the slot has a top entry opening to permit entry of the head section in the first orientation and to prevent exit of the head part in the assembled orientation. Preferably the slot includes a side assembly opening through which the neck section of the male part extends in the assembled orientation.

In one embodiment of the invention the cover element includes handle lifting means.

Ideally the cover member has an anti-slip surface.

In one embodiment the cover element includes tracking code means. Preferably the code means is housed within the cover member.

In another embodiment the cover element includes anchoring means for anchoring the cover member. The anchoring means may include an anchor formation such as a slot or hole in or on the cover member. The anchor formation may be a slot for receiving an anchoring clip.

Preferably, for ease of handling and use the cover element is from 200 mm to 500 mm long, preferably either from 200 to 300 mm long, or from 300 to 400 mm long.

The invention also provides a cover assembly comprising a number of cover elements as of the invention.

BRIEF DESCRIPTION OF THE DRAWINGS

The invention will be more clearly understood from the following description thereof given by way of example only with reference to the accompanying drawings, in which.

DETAILED DESCRIPTION

Figure 1:
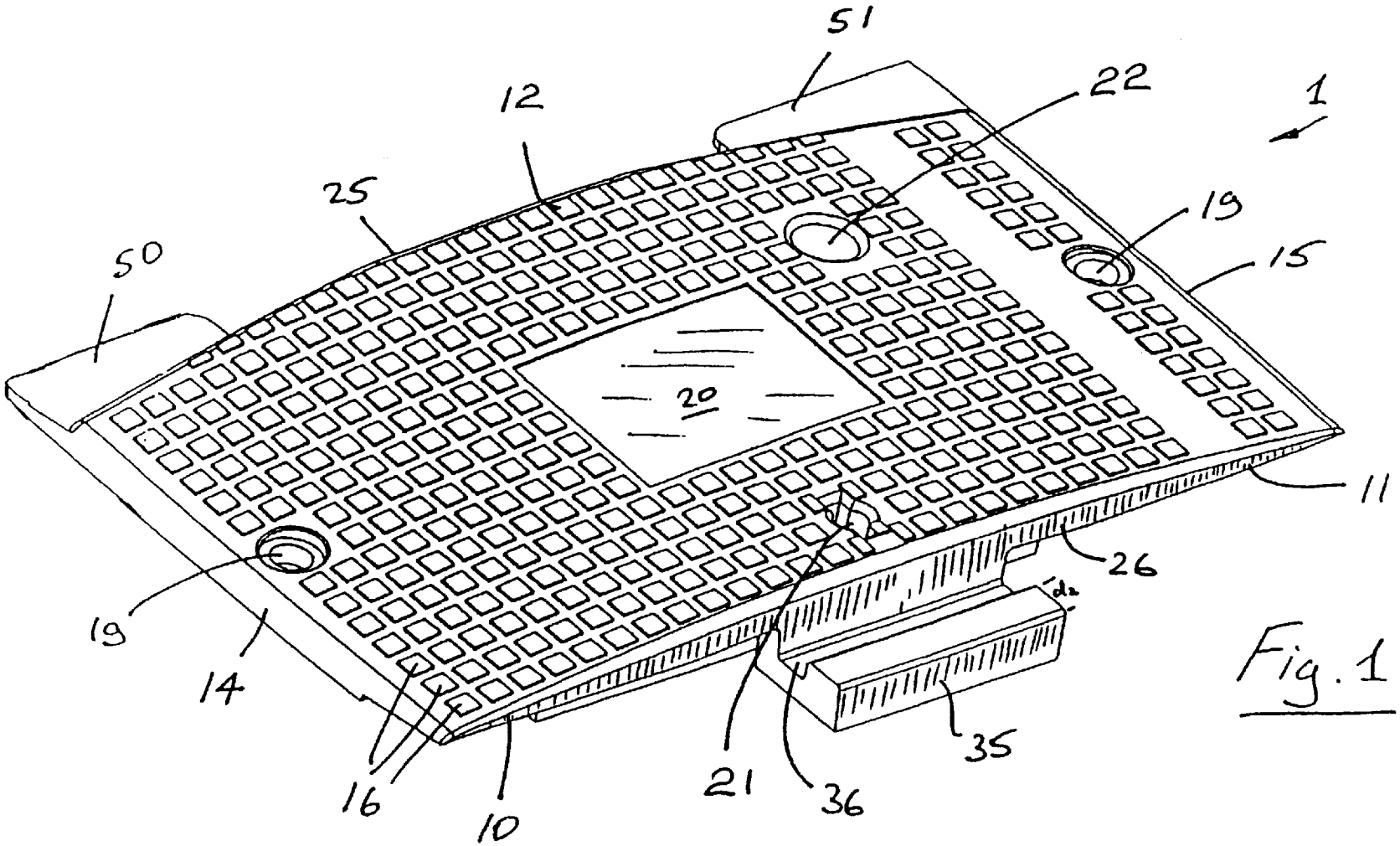
FIG. 1 is a perspective view showing the top of a trench plate according to the invention.
Figure 2:
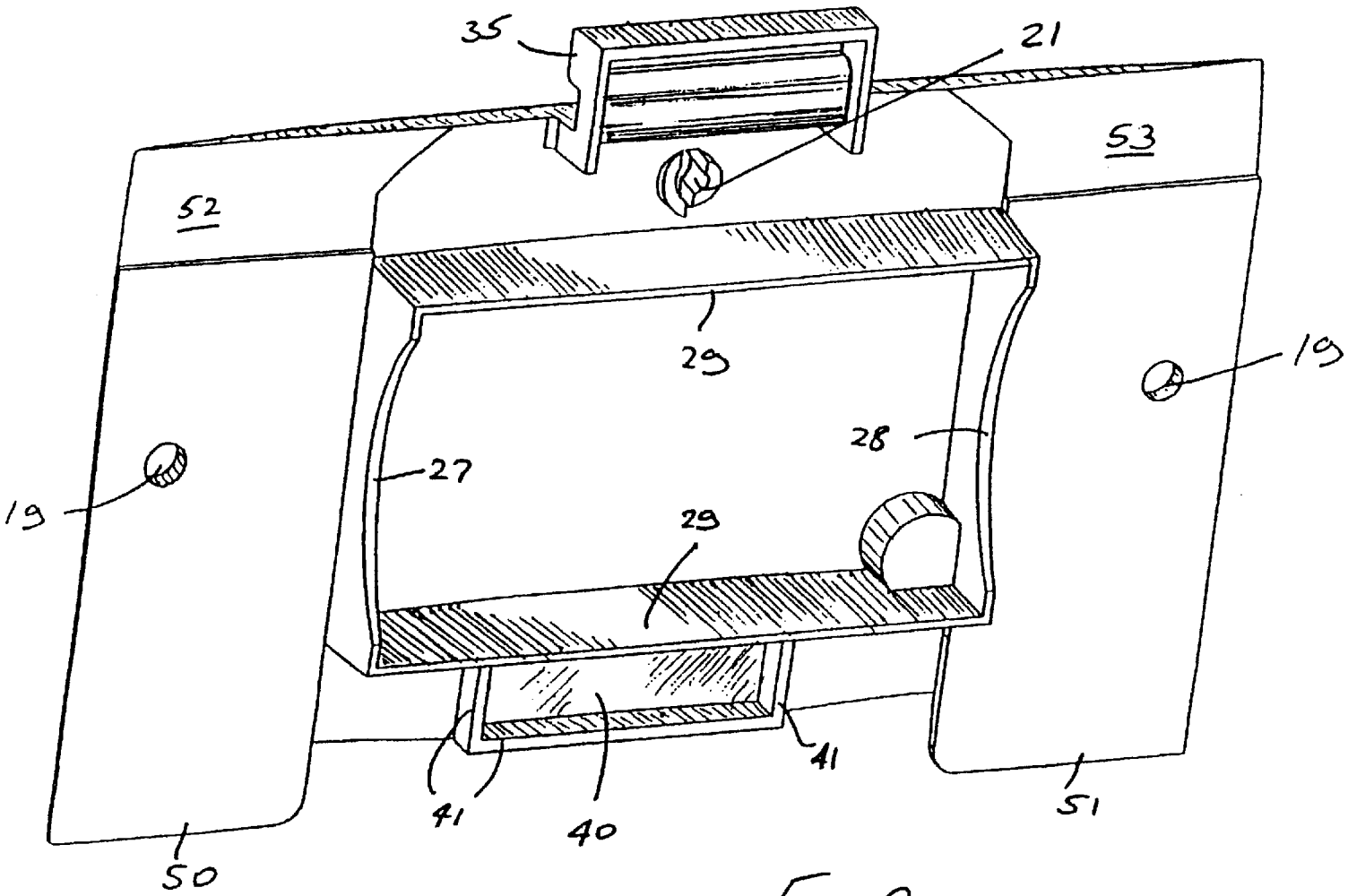
FIG. 2 is a perspective view showing the bottom of the cover element.
Figure 3:
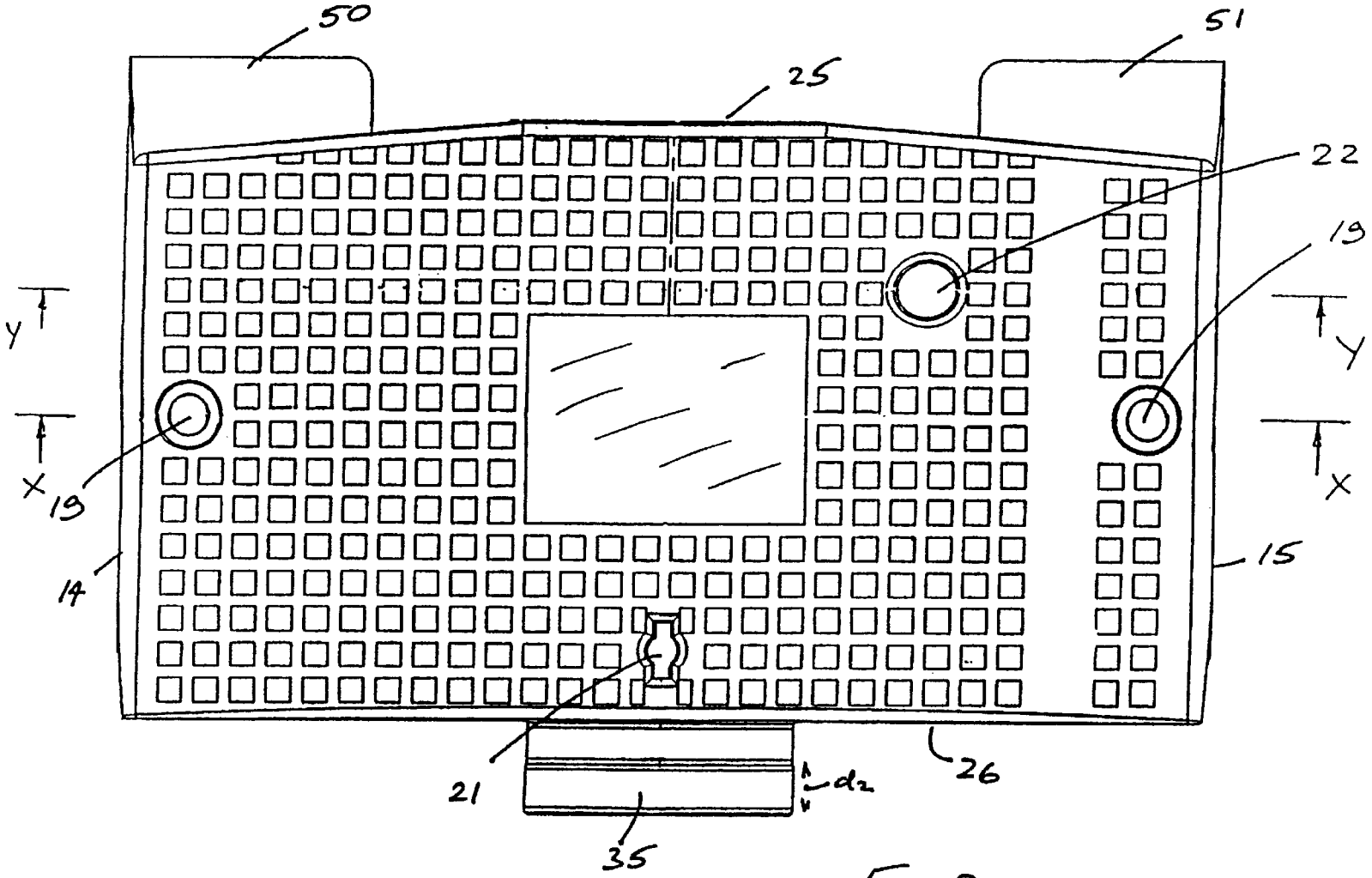
FIG. 3 is a top plan view of the cover element.
Figure 4:
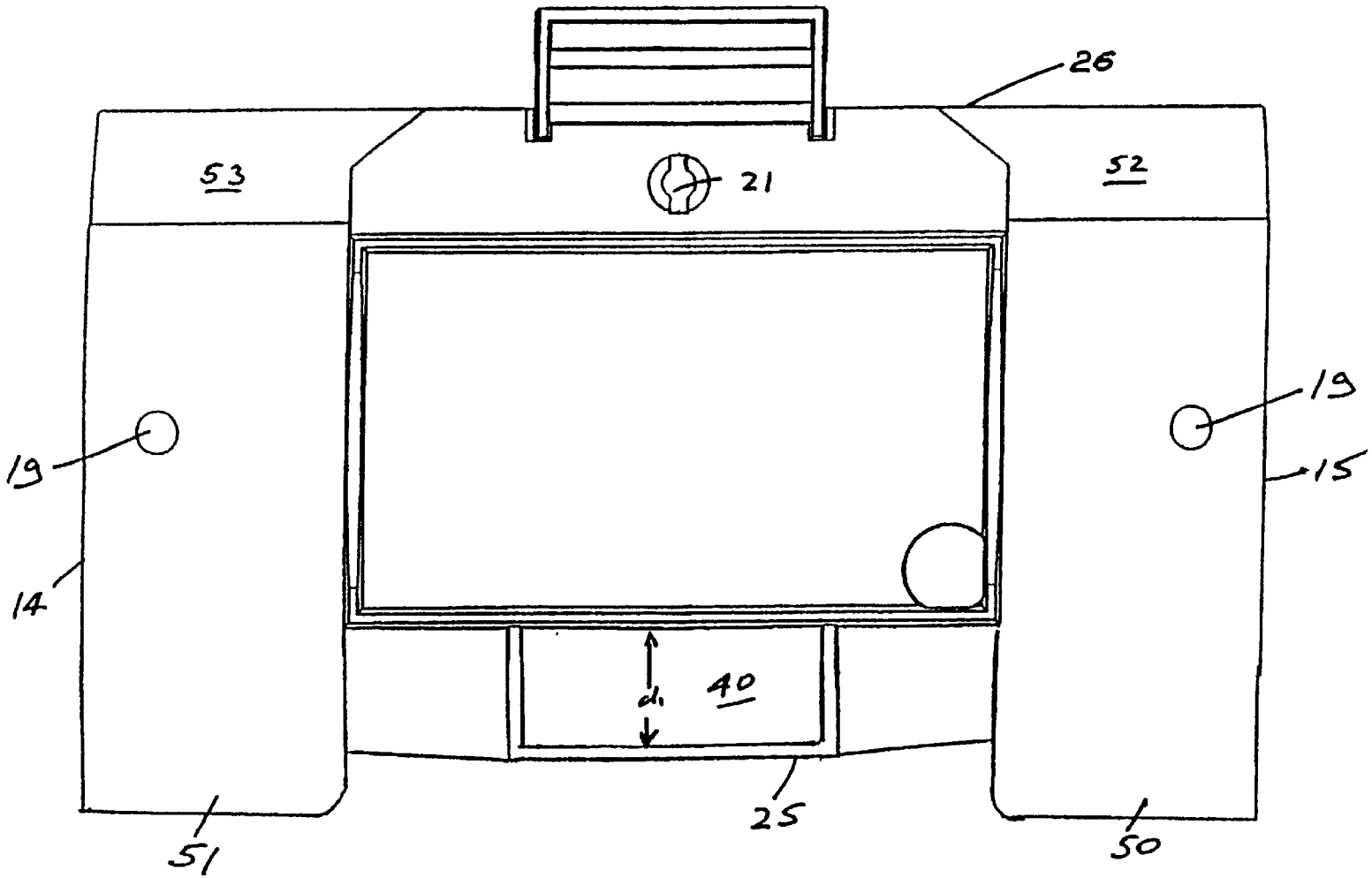
FIG. 4 is an underneath plan view of the cover element.
Figure 5:
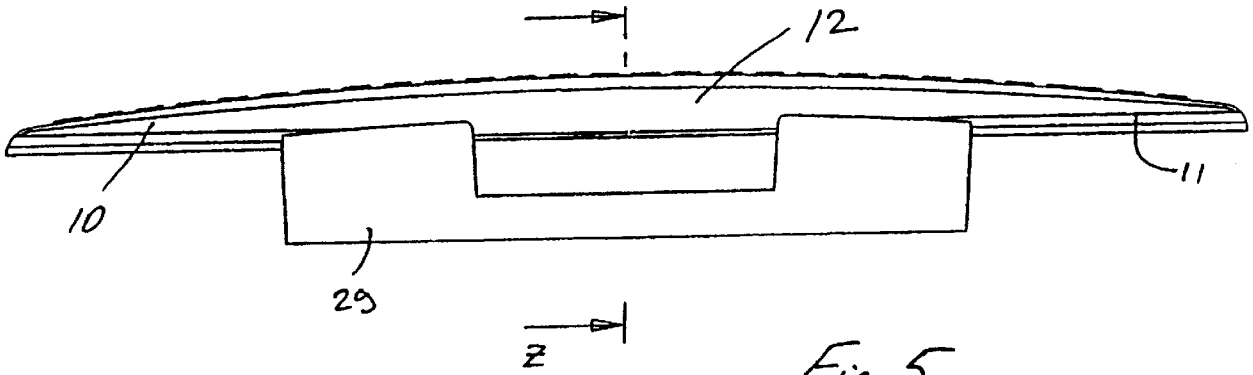
FIG. 5 is a side elevational view of the cover element.
Figure 6:
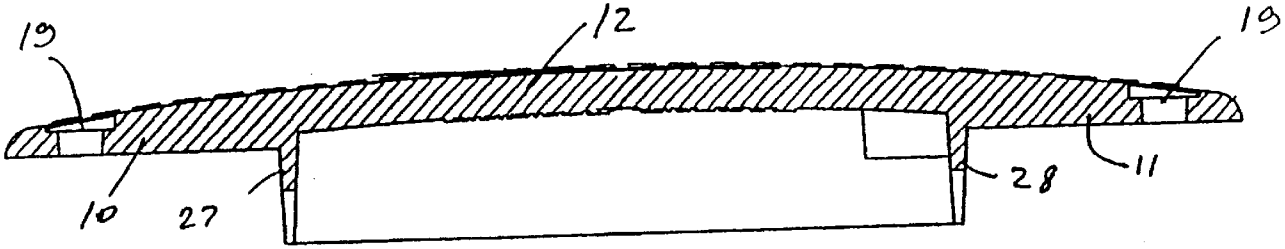
FIG. 6 is a cross sectional view on the line X—X in FIG. 3.
Figure 7:
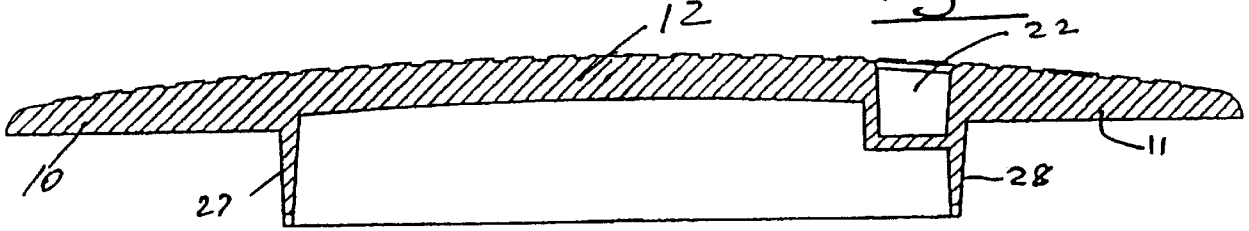
FIG. 7 is a cross sectional view on the line Y—Y in FIG. 3.
Figure 9:
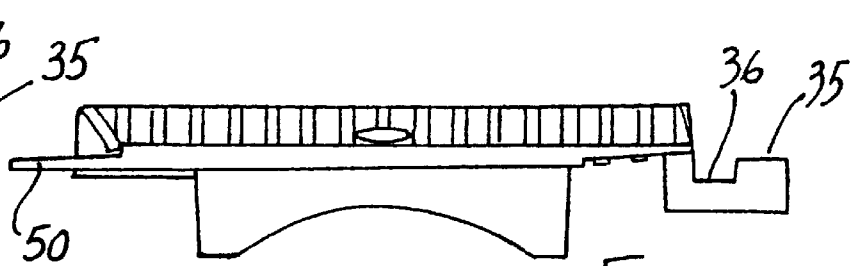
FIG. 9 is a side view of the cover element.
Figure 8:
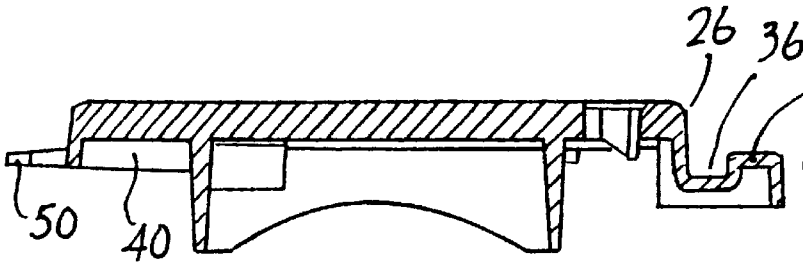
FIG. 8 is a cross sectional view on the line Z—Z in FIG. 5.
Figure 10:
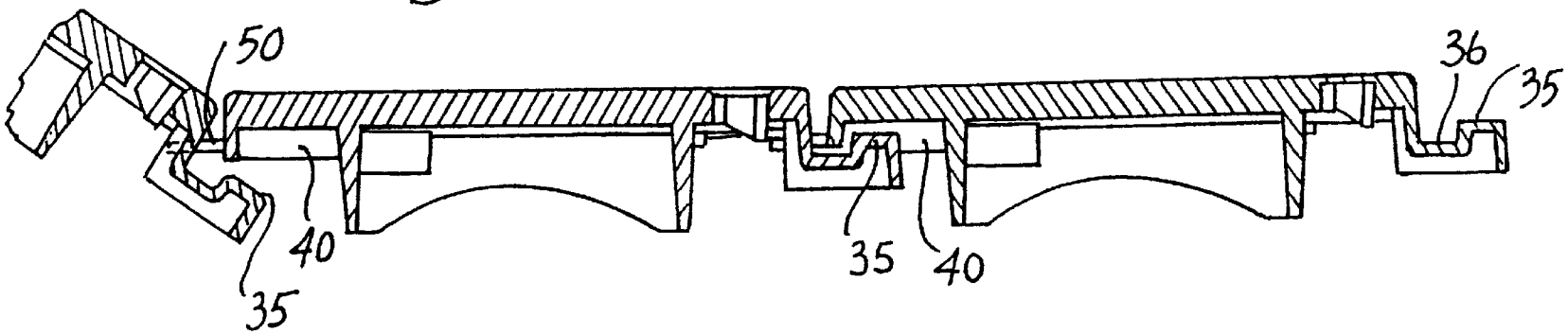
FIG. 10 is a cross sectional view showing the assembly of a number of the cover element.
Figure 11:
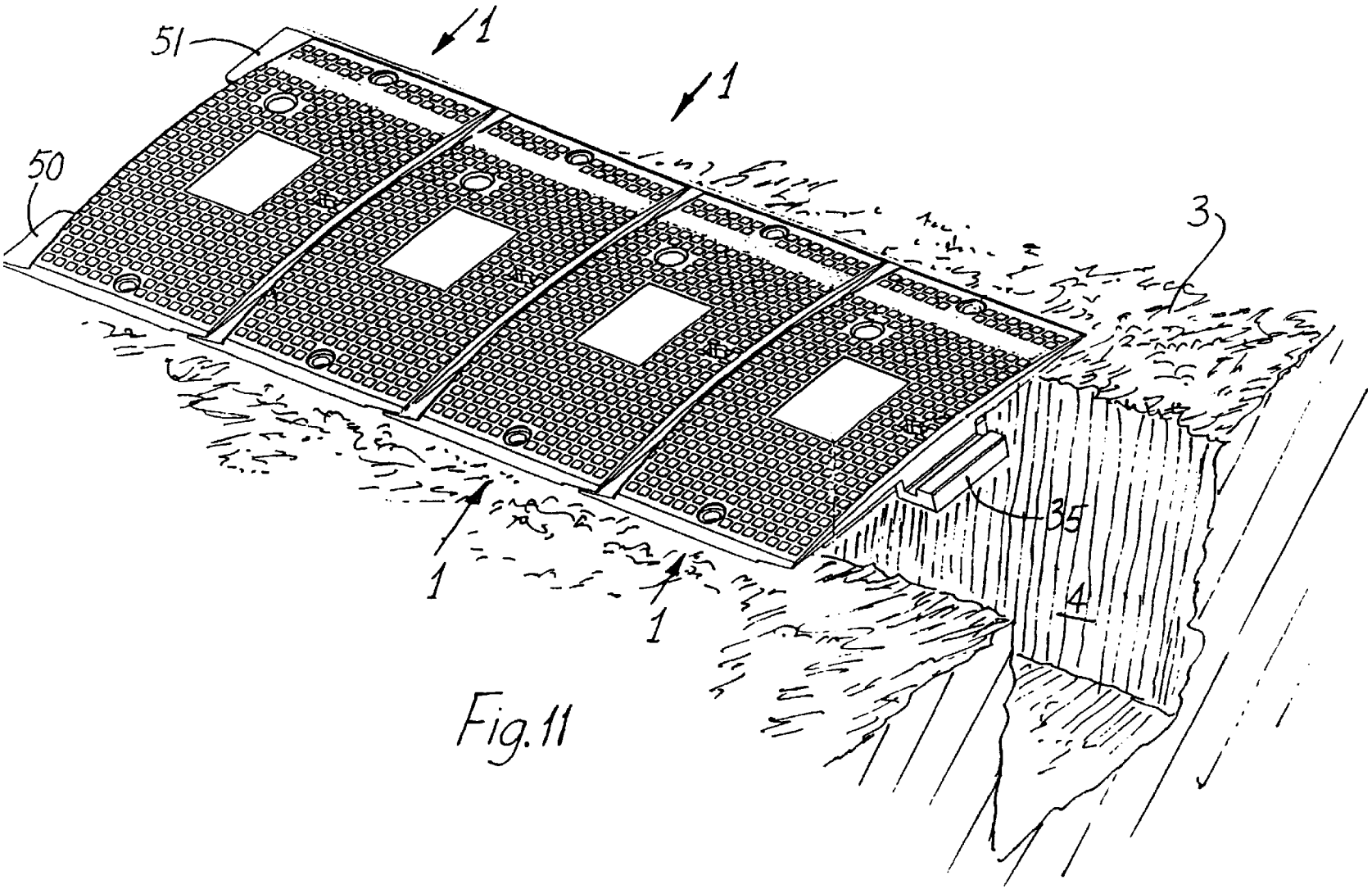
FIG. 11 is a perspective view of a number of trench cover elements in position covering a trench.
Figure 12:
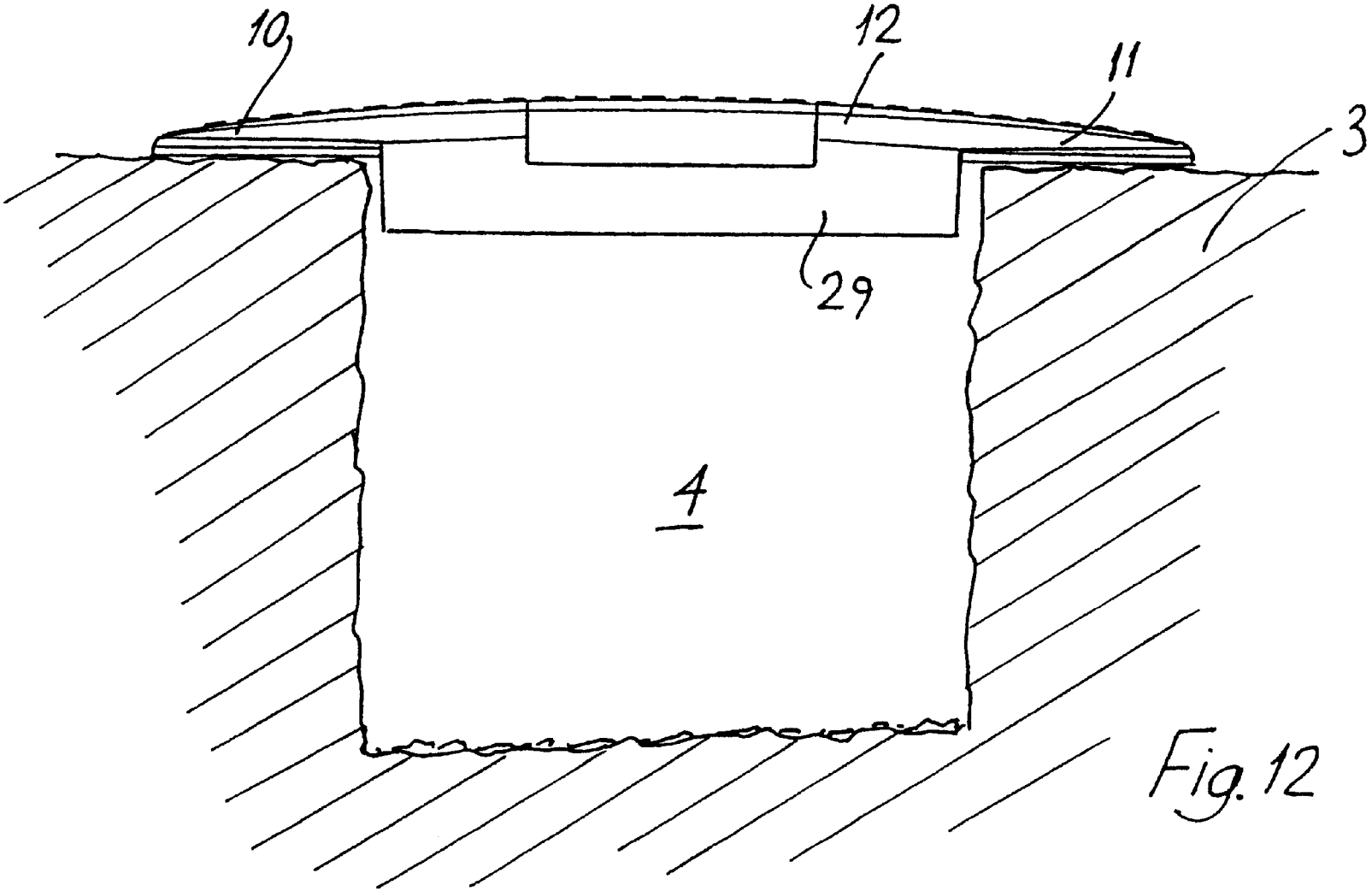
FIG. 12 is a cross sectional view of one trench cover element in position in a trench.
Figure 13:
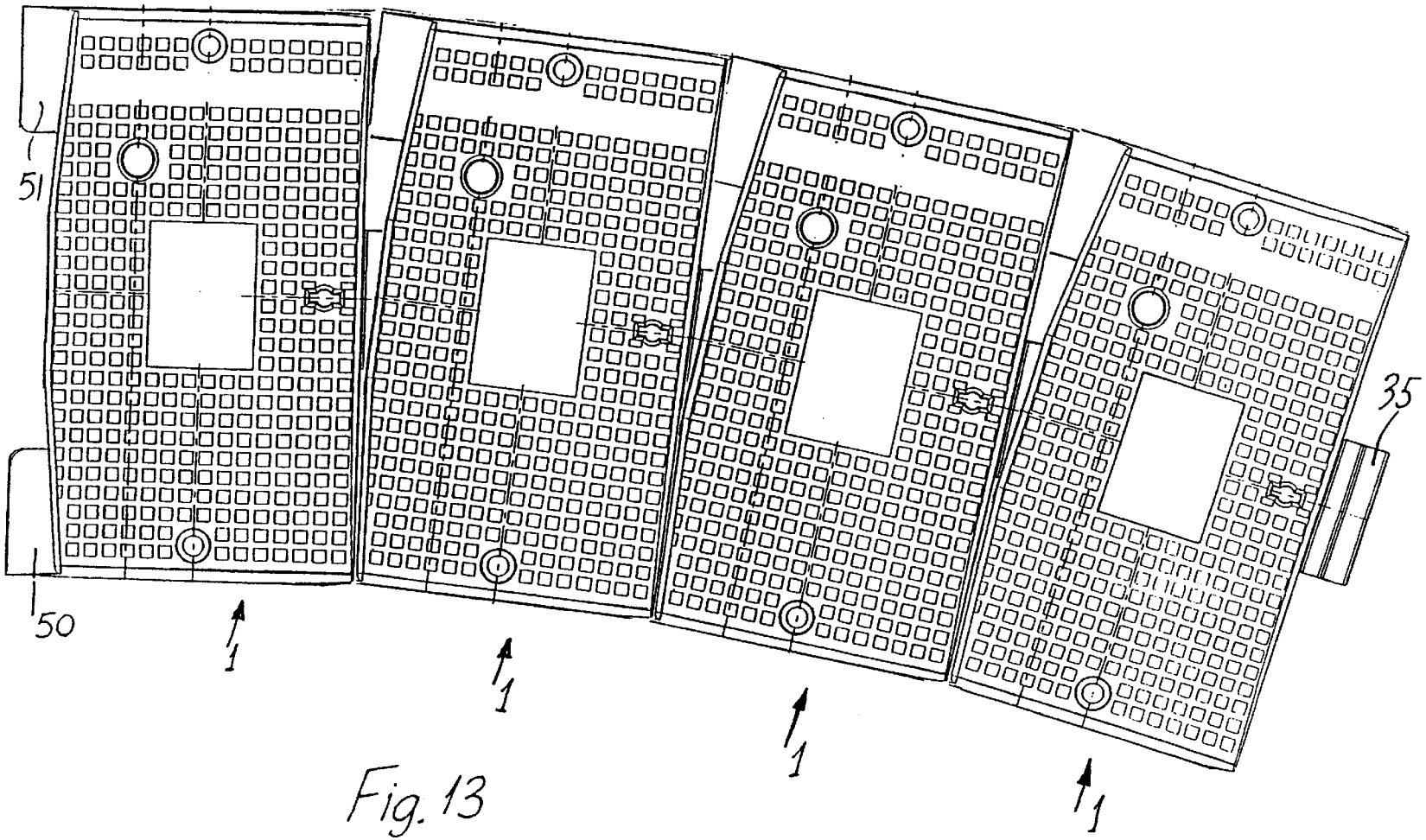
FIG. 13 is a plan view of a number of trench cover elements covering a trench with a curved contour.
Figure 14:
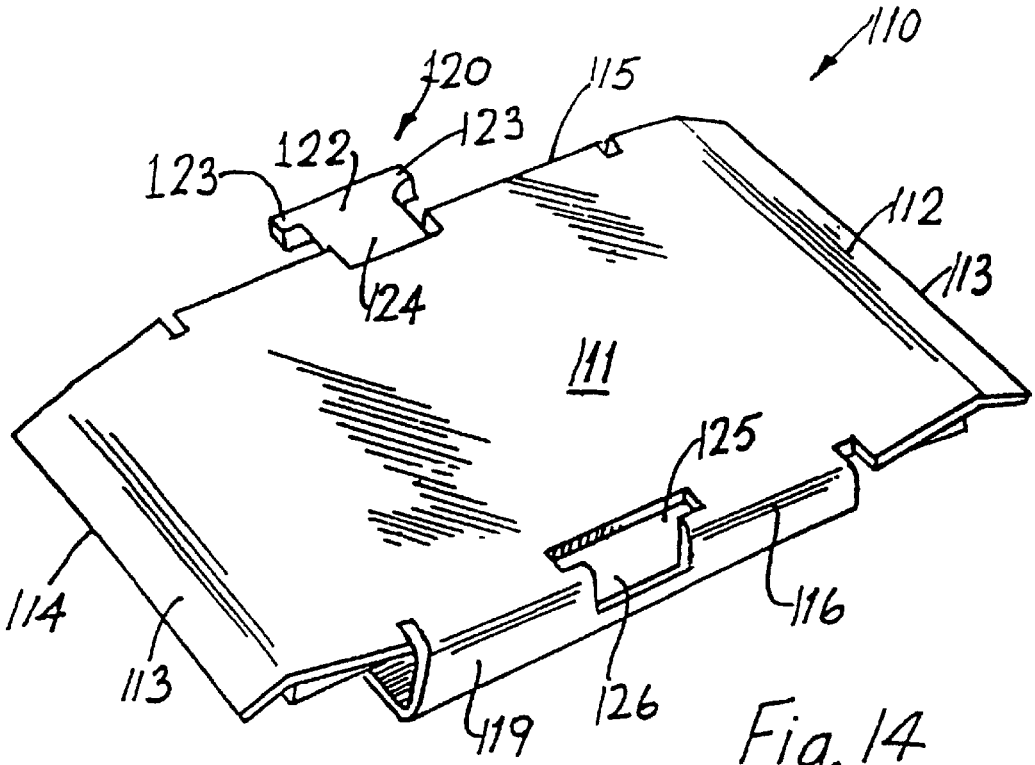
FIG. 14 is a perspective view from one side of another trench cover element.
Figure 15:
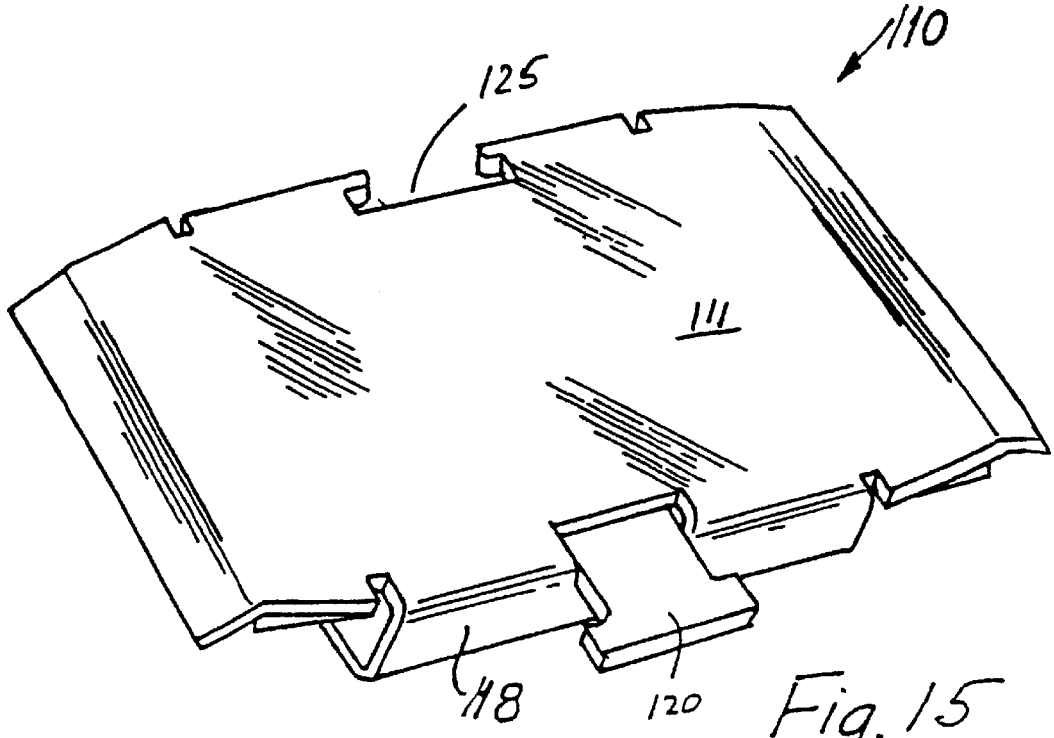
FIG. 15 is a perspective view from an opposite side of the cover element of FIG. 14.
Figure 16:
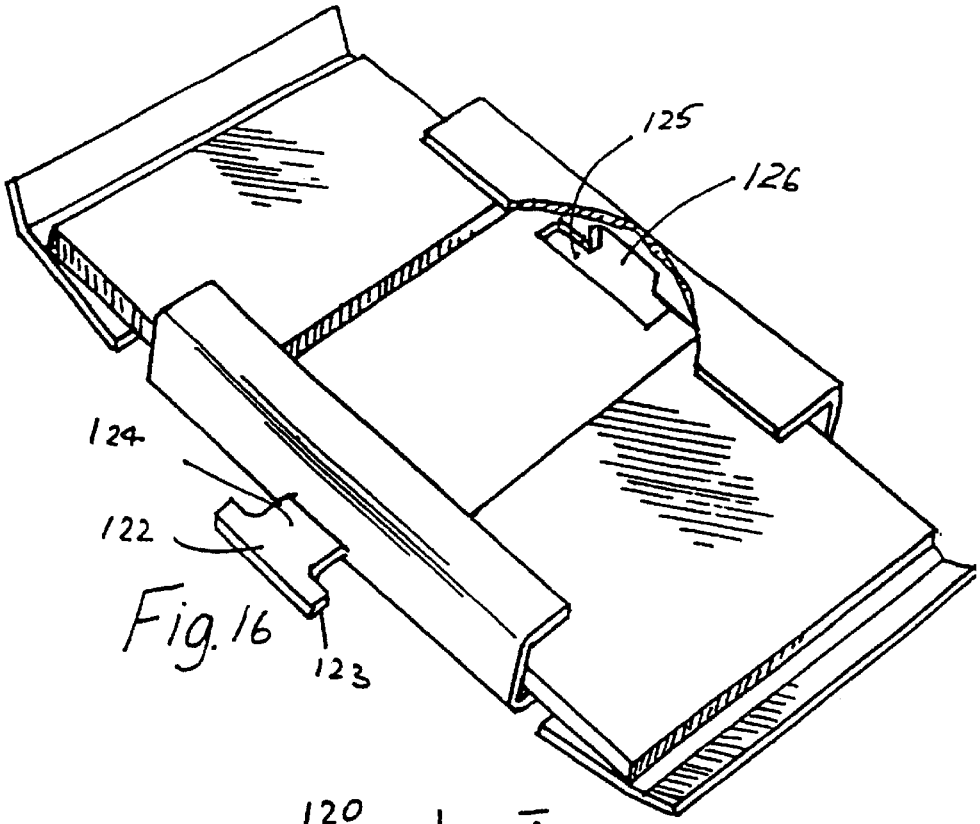
FIG. 16 is a perspective view from the underside of the cover element of FIG. 14.
Figure 17:
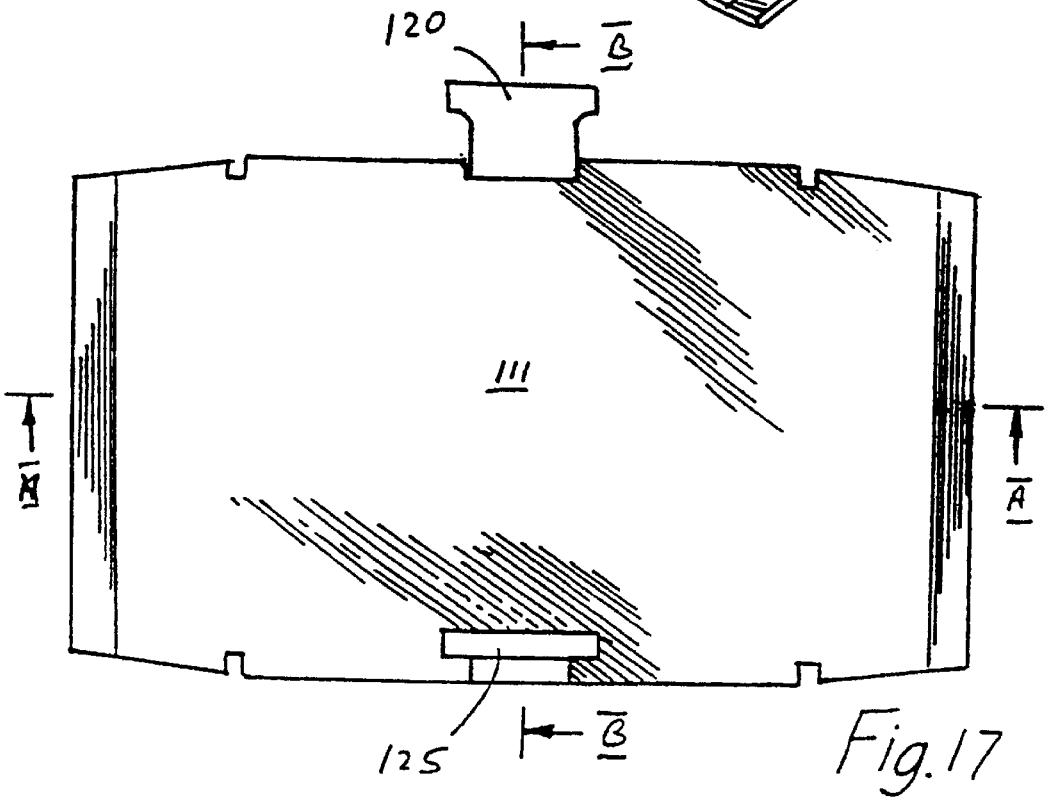
FIG. 17 is a top plan view of the cover element of FIG. 14.
Figure 18:
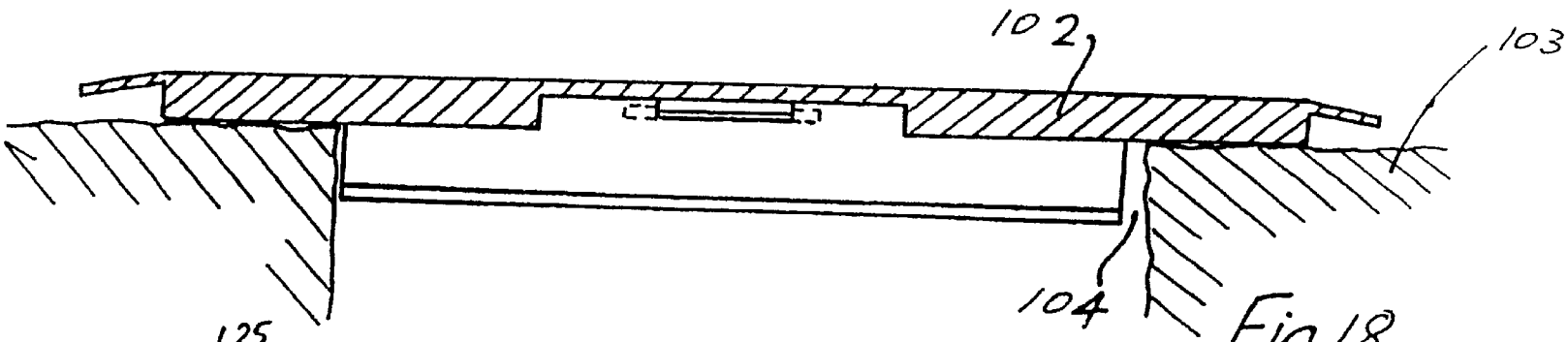
FIG. 18 is a cross sectional view on the line A—A of FIG. 17 with the cover element in position.
Figure 19:
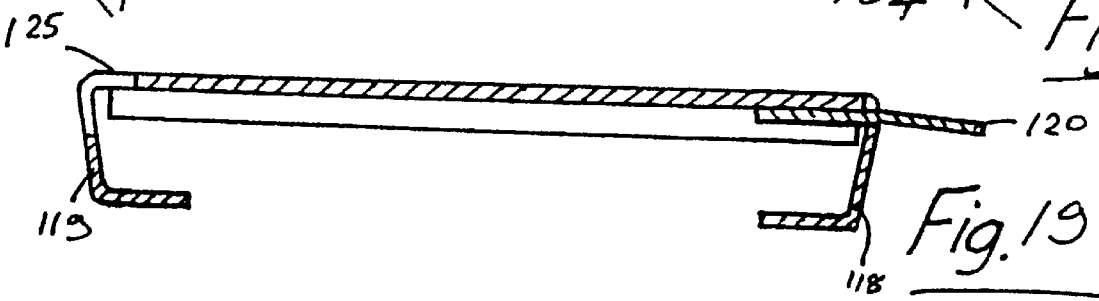
FIG. 19 is a cross sectional view on the line B—B of FIG. 17.
Figure 21:
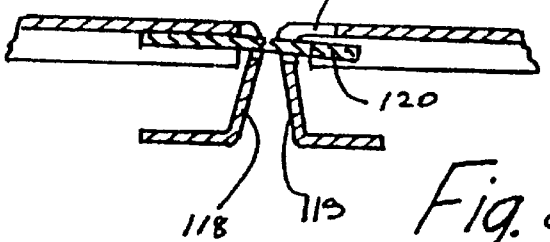
FIGS. 20 and 21 are cross sectional views of the assembly of one cover element of FIG. 14 to another.
Figure 20:
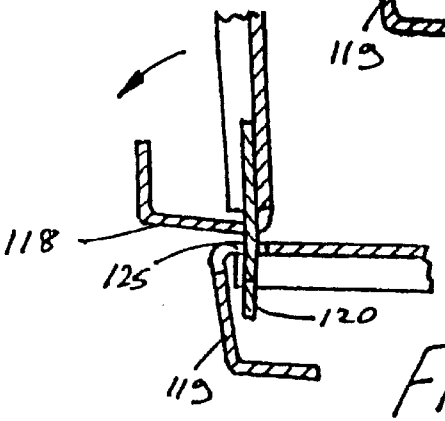
Figure 22:
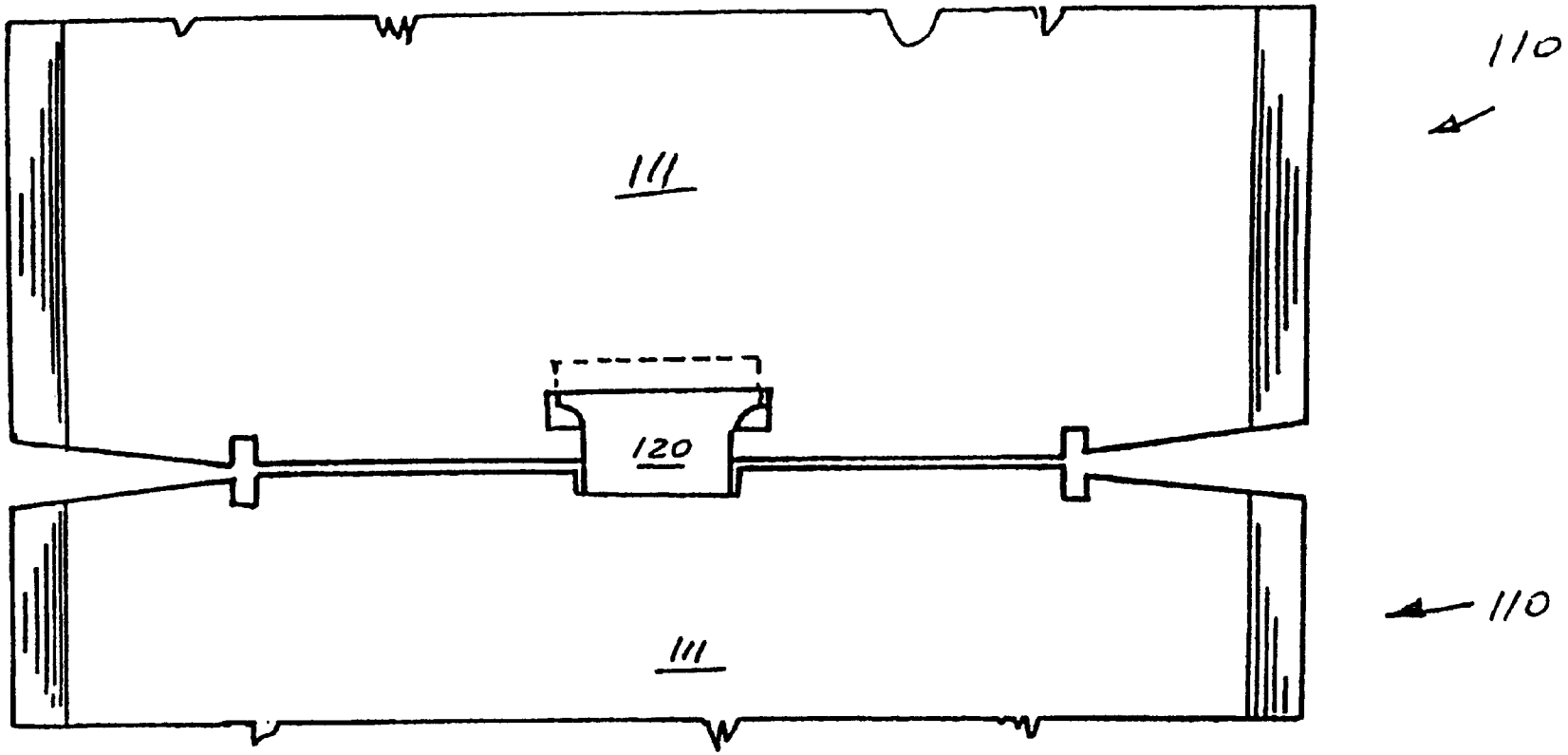
FIG. 22 is a partial top plan view of two adjacent cover elements of FIG. 14 of a trench cover assembly.

Referring to the drawings there is illustrated in FIGS. 1 to 9 and 12 a temporary trench plate cover element 1. Each cover element 1 covers part of a trench 4 in the ground 3 (FIGS. 11, 12) and a number of the cover elements 1 are interlinked to follow the contour of the ground 3 in which the trench is dug. In FIG. 11 the cover elements 1 are shown following a relatively straight course while in FIG. 13 the elements 1 are shown following a curvilinear course.

In this case the cover element 1 is of cast iron construction and comprises a cover member for extending over a trench 4, especially in a roadway. The cover ember comprises a pair of side ground engaging portions 10, 11 bridged by a central trench covering portion 12. The cover member is of generally convex shape in transverse cross section, the side portions 10, 11 reducing in cross section towards opposite side marginal edges 14, 15 of the cover member to define a slight ramp to facilitate vehicle wheels passing thereover. The exposed upper surface of the cover member has anti-slip formations which in this case are defined by generally square shaped raised portions 16. Anchor holes 19 are provided in the side portions 10, 11 to facilitate anchoring to the ground 3, if desired. A central recessed area 20 is provided for attachment of a reflector strip or the like. To facilitate erection of a post for a warning flag, sign or the like the cover member has a mounting hole 21. Another recess 22 is provided to receive a coding means such as an identity tag or transponder unit to uniquely identify the cover element 1 for tracing and the like.

The cover member has a pair of transverse ends 25, 26 extending transversely between opposite sides 14, 16. Confinement means in the form of side walls 27, 28 extend downwardly from the central portion 12 of the cover member to confine the cover with respect to the opening of the trench 4. The side walls 27, 28 are in this case joined by transverse walls 29 for enhanced mechanical strength.

Interlink means comprises a first male interlink means 30 and a second female interlink means 31, and the interlink means 30, 31 of adjacent like cover elements are interengaged on assembly of the cover elements 1. In this case the male interlink means comprises a head part 35 projecting from the transverse end 26 of the cover member. The head part 35 has an area of reduced cross section defining a neck 36 and is located centrally of the transverse end 26.

The female interlink means comprises a downwardly opening slot 40 at the transverse end 25. The slot 40 is defined in the underside of the cover member by downwardly extending walls 41 and portion of the transverse wall 29. The width $d_1$ of the slot 40 is oversize with respect to the width $d_2$ of the head part 35 of the male interlink to permit limited relative movement between adjacent cover elements on assembly so that the cover elements 1 can follow the contour of the ground. Similarly, the length of the head part 35 is less than the length of the recess 40. It will be noted that the upper ends of the head part 35 are tapered to facilitate assembly of the head part 35 into the recess 40.

The interlink means in this case also comprises a pair of end wings 50, 51 which extend from the transverse end 25. The end wings 50, 51 are located on either side of the recess 40 and extend generally from the ground engaging portions 10, 11 of the cover member. On assembly, the end wings 50, 51 are received underneath an adjacent cover element. In this case the end wings 50, 51 are received in recessed areas 52, 53 respectively flanking the head part 35.

The end wings 50, 51 engaging underneath an adjacent cover element, in combination with the inter-engagement of the head part 35 in the slot 40 secures adjacent cover elements together in such a way as to facilitate relative movement between adjacent cover elements to follow the contour of the trench.

On assembly, end cover elements are anchored to the ground and because of the inter-engagement on both transverse ends none of the cover elements in the assembly can be removed by an unauthorised person. This prevents theft and also enhances the safety aspects of the assembly. In addition, the end wings 50, 51 have the important advantage that they at least partially occlude any gap between adjacent cover elements on assembly. This is also an important safety feature as there is no gap on which to snag a bicycle wheel or the like.

At least one transverse end, in this case the end 25 is shaped to facilitate limited relative movement between end edges 25, 26 of adjacent cover elements 1. In this case the transverse end is of generally convex curvilinear shape.

Referring to FIGS. 14 to 22 there is illustrated a trench cover element 110 which in this case is of prefabricated metal, especially steel construction. The cover element 110 is in some respects similar to the cover element of FIGS. 1 to 13 and comprises a top 111 with sidewardly extending ramp sections 112. The top 111 extends over a trench opening 104 to engage the ground 103 on each side of the trench opening 104. The cover element 110 is of generally rectangular shape in plan view with a pair of side marginal edges 113, 114 which extend longitudinally of the trench opening 104 and a pair of end marginal edges 115, 116 which extend transversely of the trench opening 104. Confinement means for confining the cover element 10 in the trench opening 104 is in this case provided by downturned and inturned projections 118, 119.

Interlink means for interengaging like cover elements 110, on assembly is provided by a male link 120 at one end 115 and a female link 121 at the opposite end 116. The male link 120 comprises a projecting head part 122 with shoulders 123 and a neck part 124 connecting the male link to the main body of the cover element 110. The female link 121 is provided by a slot having a top entry opening 125 and a side assembly opening 126. On assembly, the male link 120 of one cover element 110 is inserted into the female slot 121 of an adjacent cover element. The links 120 and 121 are arranged so that the cover elements can only be engaged by placing a first cover element 110 in a horizontal orientation bridging a trench opening and then turning a like cover element into a substantially vertical orientation so that the male head part 122 is engaged in the top entry opening 125 of the slot 121 and then allowing the cover element to turn into the horizontal orientation in which the shoulders 123 of the male link part 120 are engaged behind the wall in which the side opening 126 of the slot 121 is provided. The arrangement will be apparent especially from FIGS. 20 and 21. In this assembled orientation the neck 124 of the male link 120 extends through the side opening 126.

The slot 121 is oversize with respect to the male link 120 to provide limited controlled movement between adjacent cover elements 110 on assembly to follow the contour of the ground in which the trench is dug. Thus, the side opening 126 of the slot 121 is longer than the neck 124 of the male link 120 to allow controlled relative movement between adjacent cover elements in the horizontal plane. In this way the cover elements can follow the horizontal contour of the trench and can allow, for example, a 90° turn to be effected over a 5 meter length. Similarly, the side opening 126 is sized to controlled relative movement of the male interlink element in a vertical direction to follow the vertical contour of the trench.

To facilitate relative movement in a horizontal plane preferably the end edges 115, 116 are contoured and are preferably of slightly arcuate configuration.

The cover elements are readily assembled as described above to form a rigid temporary trench cover that can be easily disassembled. Most importantly, controlled relative movement is allowed so that the cover follows the contour of the ground, preferably in both the vertical and horizontal planes. This ensures a particularly safe and even temporary surface over a trench opening.

The cover elements may include a code tracking means such as a transponder which may be housed within the cover to allow the location of the cover elements to be determined from a remote location. In this way the hire and use of the elements can be controlled.

The invention provides a simple yet extremely effective temporary cover for a trench. In use, adjacent covers are readily interconnected as described above. The fittings allow the cover to readily follow both the contour of the ground in which the trench is dug and also the path of the trench. Handles may also be provided for ease of handling of the cover.

The trench cover may be anchored into position. Usually, the cover will be anchored at either end by, for example, an anchor bolt which may subsequently be temporarily covered. The may also be anchored to the trench at any suitable point, for example at 5 m length. The anchoring may be achieved by a releasable hook linkage between the cover and a trench strut.

The trench cover assembly of the invention is easily handled and can therefore be used as a substitute for backfilling. Thus, the labour force can be concentrated on the trench digging operation, which is thereby optimised.

Many variations on the specific embodiments of the invention will be readily apparent and according to the invention is not limited to the embodiments hereinbefore described which may be varied in construction and detail.

What is claimed is:

1. A temporary trench cover element comprising a pair of ground engaging portions bridged by a central trench covering portion, the ground engaging portions defining a pair of opposite sides for location outside of a trench, a pair of transverse ends extending transversely between the opposite sides, a confinement portion extending downwardly from the central trench covering portion for confining the cover element with respect to a trench opening, an interlink portion including a first interlink portion at one transverse end and a complementary second interlink portion at an opposite transverse end for flexibly securing adjacent cover elements together, one of the first and second interlink portions being engagable underneath the other of the first and second interlink portions of another cover element on assembly of a plurality of cover elements, at least one of the pair of transverse ends having a non-linear shape between the opposite sides allowing lateral relative separating movement between at least a portion of adjacent cover elements, one cover element being relatively movable with respect to an adjacent cover element while interengaged by the interlink portion to follow a contour of a curved trench, and at least one wing extending from one of the transverse ends to extend underneath an adjacent cover element for a distance to bridge at least a portion of a gap between adjacent cover elements when following the contour of the curved trench and when secured together by said interlink portion.

2. A cover element as claimed in claim 1 wherein one of the interlink portions is oversize with respect to the other of the interlink portions to allow limited relative movement between the interlink portions so that the cover elements follow the contour of the ground.

3. A cover element as claimed in claim 1 wherein the interlink portions of adjacent cover elements are relatively moveable in a vertical direction to follow the vertical contour of the trench.

4. A cover element as claimed in claim 1 wherein the interlink portions of adjacent cover elements are relatively movable in a horizontal direction to follow the horizontal contour of the trench.

5. A cover element as claimed in claim 1 wherein the first interlink portion comprises a head part projecting from a transverse end of a cover member and the second interlink portion comprises a slot adjacent a transverse end of a cover member to receiver the head part of a first interlink portion of an adjacent cover element on assembly.

6. A cover element as claimed in claim 5 wherein the second interlink portion comprises a slot defined in an underside of the cover element.

7. A cover element in claim 6 wherein the slot is a downwardly opening slot and the head part engages in the slot from below.

8. A cover element as claimed in claim 7 wherein the slot is oversize with respect to the head part to allow limited relative movement between the head part and the slot so that a cover element may be moved relative to an adjacent cover element to follow the contour of a trench.

9. A cover element as claimed in claim 1 wherein the second interlink portion comprises a slot defined in an underside of the cover element.

10. A cover element as claimed in claim 9 wherein the slot is defined in an underside of the central portion of the cover element.

11. A cover element as claimed in claim 1 wherein the cover element has a wing receiving recess to receive a portion of the wing of an adjacent cover element, on assembly.

12. A cover element as claimed in claim 1 wherein the wing is located to at least one side of of the interlink portions.

13. A cover element as claimed in claim 1 wherein there are two transversely spaced-apart wings.

14. A cover element as claimed in claim 1 wherein the first interlink portion is a slot at a first transverse end and the wing extends from the first transverse end.

15. A cover element as claimed in claim 1 wherein at least one end marginal edge is of curvilinear shape.

16. A cover element as claimed in claim 1 wherein at least one end marginal edge is of arcuate shape.

17. A cover element as claimed in claim 16 wherein the at least one end marginal edge is of convex shape.

18. A cover element as claimed in claim 1 wherein the first interlink portion comprises a male part projecting from one transverse end and the second interlink portion comprises a slot adjacent the opposite transverse end for receiving the head part of an adjacent cover element, on assembly, the head part and slot being shaped to facilitate assembly of the head part into the slot in a first orientation of the head part form the slot in another, assembled orientation.

19. A cover element as claimed in claim 18 wherein the male part has a projecting head section and a neck section of reduced width with respect to the head section.

20. A cover element as claimed in claim 19 wherein the slot has a top entry opening to permit entry of the head section in the first orientation and to prevent exit of the head part in the assembled orientation.

21. A cover element as claimed in claim 20 wherein the slot includes a side assembly opening through which the neck section of the male part extends in the assembled orientation.

22. A cover element as claimed in claim 1 further comprising a handle lifting portion.

23. A cover element as claimed in claim 1 wherein an anti-slip surface forms an upper surface.

24. A cover element as claimed in claim 1 further comprising a tracking code portion.

25. A cover element as claimed in claim 24 wherein the code portion is housed within an upper surface.

26. A cover element as claimed in claim 1 further comprising an anchoring portion for anchoring the cover element.

27. A cover element as claimed in claim 26 wherein the anchoring portion includes an anchor formation in or on the cover element.

28. A cover element as claimed in claim 27 wherein the anchor portion is a slot for receiving an anchoring clip.

29. A cover element as claimed in claim 1 wherein a length is from 200 mm to 500 mm.

30. A cover element as claimed in claim 29 wherein a length is from 200 to 300 mm.

31. A cover element as claimed in claim 29 wherein a length is from 300 to 400 mm.

32. A cover assembly comprising a number of cover elements as claimed in claim 1.

* * * * *